US009303362B2

(12) United States Patent
Pleyber et al.

(10) Patent No.: US 9,303,362 B2
(45) Date of Patent: Apr. 5, 2016

(54) CLOTH-LIKE TEXTURED NONWOVEN FABRIC COMPRISING PAPERMAKING FIBERS, CALENDERING ROLLER AND METHOD OF MANUFACTURING THE SAME

(71) Applicant: SCA TISSUE FRANCE, Saint-Ouen (FR)

(72) Inventors: Emilie Pleyber, Selestat (FR); Jean-Louis Jehl, Artolsheim (FR); Pierre Laurent, Turkheim (FR); Christian Bourret, Ouzouer-sur-Trezee (FR); Xavier Caresmel, Arrabloy (FR); Benoit Hoeft, Bischwihr (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 14/413,739

(22) PCT Filed: Jun. 21, 2013

(86) PCT No.: PCT/IB2013/001314

§ 371 (c)(1),
(2) Date: Jan. 9, 2015

(87) PCT Pub. No.: WO2014/009784

PCT Pub. Date: Jan. 16, 2014

(65) Prior Publication Data

US 2015/0140240 A1 May 21, 2015

(30) Foreign Application Priority Data

Jul. 10, 2012 (EP) ..... 12290231

(51) Int. Cl.
*B31F 1/07* (2006.01)
*D21H 25/00* (2006.01)
(Continued)

(52) U.S. Cl.
CPC ..... *D21H 25/005* (2013.01); *B31F 1/07* (2013.01); *D04H 1/00* (2013.01); *D04H 1/732* (2013.01);
(Continued)

(58) Field of Classification Search
CPC ..... B31F 1/07; B31F 2201/0715; B31F 2201/0733; B31F 2201/0735; B31F 2201/0738; D21G 1/02
USPC ..... 492/20, 26, 30, 31, 33, 34, 35, 36
See application file for complete search history.

(56) References Cited

U.S. PATENT DOCUMENTS 1,988,787 A * 1/1935 Fowler ..... B29C 59/022 264/167
4,659,608 A * 4/1987 Schulz ..... B31F 1/07 428/171

(Continued)

FOREIGN PATENT DOCUMENTS

WO WO-2008/132331 A1 11/2008

*Primary Examiner* — Essama Omgba
(74) *Attorney, Agent, or Firm* — Drinker Biddle & Reath LLP

(57) ABSTRACT

A calendering roller used to manufacture textured nonwoven fabric including papermaking fibers is disclosed. The calendering roller includes a positive pattern that includes a basic element having a ring shape and a repetition of said basic element along multiple rows and columns substantially overall a peripheral surface of the calendaring roller. The ring defines an apex relatively to a center portion of the ring defining a cavity and a grinded surrounding zone. The ring includes at least one radial channel putting in communication the cavity and the grinded surrounding zone so as to define a discontinuous calendering surface. The repetition is regular except for multiple substantially longitudinally and transversally oriented regions. The regions are of limited size with respect to a calendering roller size and randomly distributed so as to define multiple random longitudinal and transverse lines in the textured nonwoven fabric including papermaking fibers, generating a cloth-like visual texture.

16 Claims, 5 Drawing Sheets

(51) Int. Cl.

| | |
|---|---|
| ***D04H 1/00*** | (2006.01) |
| ***D21H 27/00*** | (2006.01) |
| ***D21H 27/02*** | (2006.01) |
| ***D04H 1/732*** | (2012.01) |
| ***D06C 15/02*** | (2006.01) |
| ***D06C 15/08*** | (2006.01) |
| ***D21G 1/02*** | (2006.01) |

(52) U.S. Cl.

CPC ..... *D06C 15/02* (2013.01); *D06C 15/08* (2013.01); *D21G 1/02* (2013.01); *D21H 27/002* (2013.01); *D21H 27/02* (2013.01); *B31F 2201/0733* (2013.01); *D10B 2403/012* (2013.01); *D10B 2503/00* (2013.01); *Y10T 428/1303* (2015.01); *Y10T 428/24355* (2013.01)

(56) References Cited

U.S. PATENT DOCUMENTS

| | | | | | |
|---|---|---|---|---|---|
| 5,036,758 | A * | 8/1991 | Kobayashi et al. | ..... | 101/28 |
| 5,573,830 | A * | 11/1996 | Schulz | ..... | 428/156 |
| 5,597,639 | A * | 1/1997 | Schulz | ..... | 428/156 |
| 5,686,168 | A * | 11/1997 | Laurent et al. | ..... | 428/179 |
| 5,858,512 | A | 1/1999 | Dit Picard et al. | | |
| 5,874,156 | A * | 2/1999 | Schulz | ..... | 428/156 |
| 6,029,570 | A * | 2/2000 | Matuschczyk | ..... | 100/121 |
| 6,558,511 | B2 * | 5/2003 | Dwiggins et al. | ..... | 162/112 |
| 6,887,349 | B2 * | 5/2005 | Ruthven et al. | ..... | 162/114 |
| 7,297,226 | B2 * | 11/2007 | Schulz | ..... | 162/117 |
| 7,326,322 | B2 * | 2/2008 | Ruthven et al. | ..... | 162/362 |
| 7,413,629 | B2 * | 8/2008 | Fisher et al. | ..... | 162/117 |
| 7,435,313 | B2 * | 10/2008 | Boatman | ..... | B31F 1/07 156/209 |
| 7,524,404 | B2 * | 4/2009 | Boatman et al. | ..... | 162/362 |
| 7,597,777 | B2 * | 10/2009 | Wilke, II | ..... | 162/117 |
| 7,678,034 | B2 * | 3/2010 | Wilhelm | ..... | 492/33 |
| 7,678,229 | B2 * | 3/2010 | Wilke, II | ..... | 162/117 |
| 7,785,696 | B2 * | 8/2010 | Boatman et al. | ..... | 428/156 |
| 7,799,161 | B2 * | 9/2010 | Schuh et al. | ..... | 156/209 |
| 8,187,427 | B2 * | 5/2012 | Schuh et al. | ..... | 162/362 |
| 8,309,204 | B2 | 11/2012 | Graff | | |
| 8,973,267 | B2 * | 3/2015 | Gelli | ..... | 29/895.3 |
| 2003/0008109 | A1 * | 1/2003 | Basler et al. | ..... | 428/156 |
| 2005/0138981 | A1 * | 6/2005 | Wilhelm | ..... | 72/197 |
| 2005/0257910 | A1 * | 11/2005 | Boatman | ..... | B31F 1/07 162/362 |
| 2006/0286885 | A1 | 12/2006 | Schuh et al. | | |
| 2007/0062658 | A1 | 3/2007 | Wiwi et al. | | |
| 2010/0028621 | A1 | 2/2010 | Byrne et al. | | |

* cited by examiner

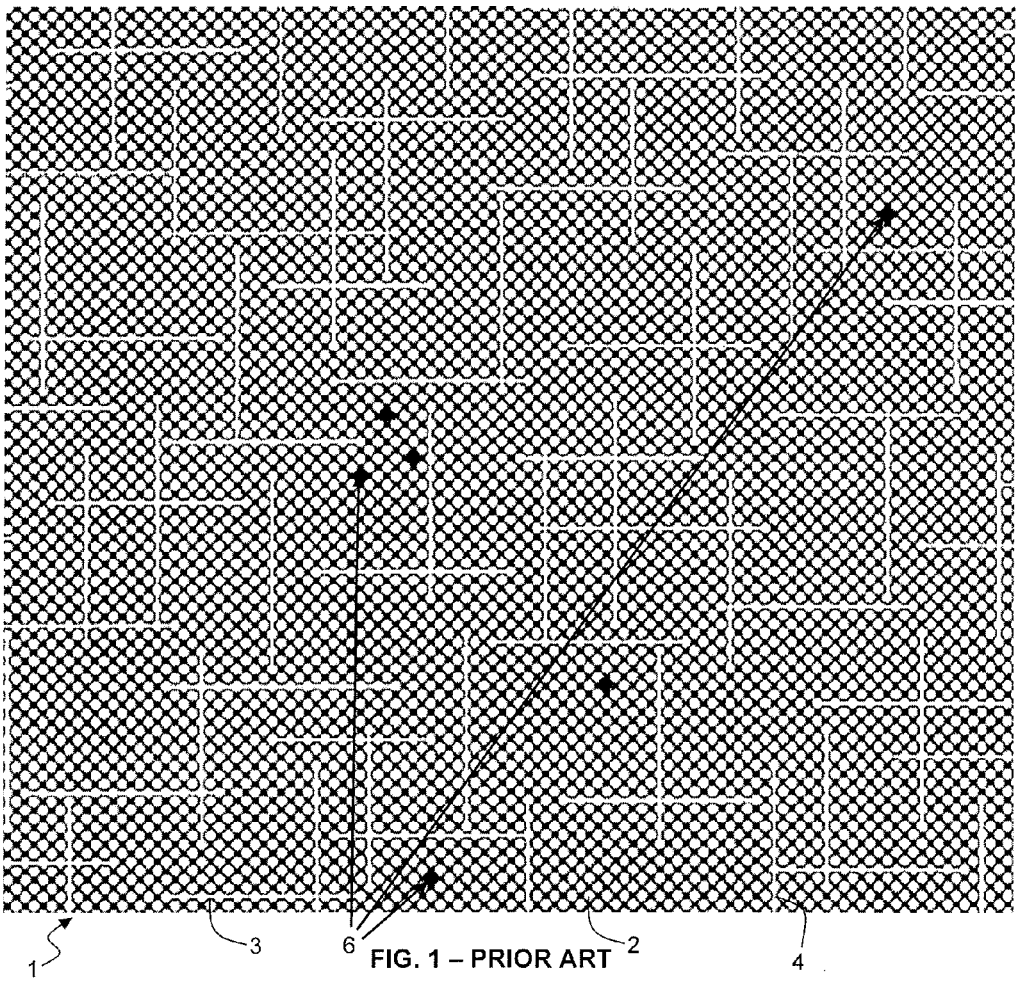
FIG. 1 – PRIOR ART
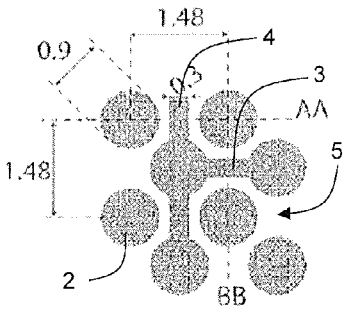
FIG. 2 – PRIOR ART
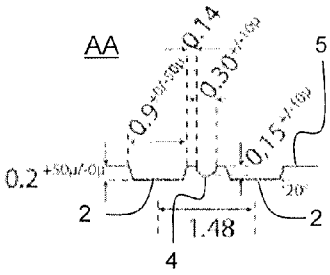
FIG. 3 – PRIOR ART
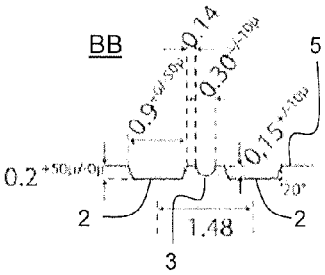
FIG. 4 – PRIOR ART

CLOTH-LIKE TEXTURED NONWOVEN FABRIC COMPRISING PAPERMAKING FIBERS, CALENDERING ROLLER AND METHOD OF MANUFACTURING THE SAME

CROSS-REFERENCE TO RELATED APPLICATIONS

This application is a §371 National Stage application of PCT International Application No. PCT/IB2013/001314 filed Jun. 21, 2013, which claims priority to EP 12290231.5, filed Jul. 10, 2012, both of which are incorporated by reference herein in their

TECHNICAL FIELD

The disclosure relates to a cloth-like textured nonwoven fabric including papermaking fibers. Further, the disclosure relates to a method of manufacturing a cloth-like textured nonwoven fabric including papermaking fibers. Yet further, the disclosure relates to a calendering roller for manufacturing a cloth-like textured nonwoven fabric including papermaking fibers. Such a cloth-like textured nonwoven fabric including papermaking fibers, finds a particular, though non-exclusive, application in the industry of nonwoven fabric including papermaking fibers. Cloth-like textured paper may be used for sanitary or domestic purposes. As a particular example, it may be used to manufacture table top range product like napkins, table cover, placemates, table runners, coasters, and doyleys. Other examples are also possible, like paper towels, toilet paper rolls, facial rolls, wiping paper products, kitchen towel rolls, skin care or cleaning wipes, handkerchiefs, absorbent pads, or decorative products like curtains or household products.

BACKGROUND

In the following, a nonwoven fabric including papermaking fibers relates to an absorbent paper which is also called nonwoven or web made of fibers like air-laid web in this field of technology. A typical absorbent paper has a basis weight, in the range from 30 to 250 g/m$^2$, or 45 to 75 g/m$^2$ for the table top range product.

FIG. 1 is a schematic representation of a known pattern 1 of a calendering roller that is used to manufacture textured nonwoven fabric including papermaking fibers. FIG. 2 schematically shows an enlarged view of said pattern. The pattern 1 includes multiple cavities 2 (appearing as circular dots in white in FIG. 1) arranged according to rows and columns and also multiple horizontal channels 3 and vertical channels 4 (appearing as straight lines in white in FIG. 1) substantially overall a peripheral surface of the calendering roller. The pattern 1 is a negative pattern meaning that the cavities and channels bottoms are below the contacting surface 5 as best seen in FIGS. 3 and 4 which represents cross-sectional views according to lines AA and BB of FIG. 2, respectively. A first drawback of this calendering roller is that the contacting surface 5 is important. A second drawback of this calendering roller is that the pattern easily gathers papermaking fibers and becomes dirty as a result of the compression during the calendering process. In particular, some of the cavities may be fouled up with an aggregate of papermaking fibers 6. This results in a produced textured nonwoven fabric including papermaking fibers, which is of low quality and includes "dark points", low quality meaning that the resulting textured nonwoven fabric including papermaking fibers, is not well perceived by the consumers. The "dark points" are formed by a localized high density of papermaking fibers. This occurs when such aggregates of papermaking fibers are released from the cavity and incorporated into the textured nonwoven fabric including papermaking fibers during the calendering process. This is particularly noticeable for pattern having a density of dots ranging between 65 and 120 dots/cm$^2$, and more particularly ranging between 70 and 90 dots/cm$^2$. Further, these "dark points" affect both white and colored nonwoven fabric including papermaking fibers (though more visible on colored product).

There is a need to improve the aesthetic quality of the textured nonwoven fabric including papermaking fibers, and in particular to avoid the appearance of "dark points" in the textured nonwoven fabric including papermaking fibers so as to produce a cloth-like textured paper that is appealing to the eyes of the consumers.

SUMMARY

It is desired to create a textured nonwoven fabric including papermaking fibers, and/or a calendering roller, and/or a manufacturing method that overcomes the drawbacks of the prior art textured nonwoven fabric including papermaking fibers, calendering roller, and/or manufacturing method, respectively.

According to one aspect, there is provided a calendering roller used to manufacture textured nonwoven fabric including papermaking fibers, the calendering roller including a positive pattern that includes:

- a basic element having a ring shape, the ring defining an apex relatively to a center portion of the ring defining a cavity and a grinded surrounding zone, the ring including at least one radial channel putting in communication, the cavity and the grinded surrounding zone so as to define a discontinuous calendering surface;
- a repetition of said basic element along multiple rows and columns substantially overall a peripheral surface of the calendering roller, the repetition being regular except for multiple substantially longitudinally and transversally oriented regions, said regions being of limited size with respect to a calendering roller size and randomly distributed so as to define multiple random longitudinal and transverse lines in the textured nonwoven fabric including papermaking fibers, generating a cloth-like visual texture.

The ring may have a shape chosen from among the group of an elliptical, a circular, a square, a rectangular and a diamond shape.

The ring may include four radial channels symmetrically positioned around the ring.

The ring may have a planar apex and the cavity may have a rounded bottom.

The cavity may have a relief angle ranging between 20° and 30°.

At least a part of the multiple rows and columns, or the substantially transversally and longitudinally oriented regions may define waviness longitudinal and transverse lines, respectively.

A thickness of said regions may be at least approximately half a basic element size.

A length of said regions may be at least approximately four basic element size.

According to another aspect, there is provided a method of manufacturing textured nonwoven fabric including papermaking fibers, including a web made of nonwoven fabric including papermaking fibers, wherein the manufacturing method includes producing a web made of nonwoven fabric including papermaking fibers by an air-laid production process, and calendering the web by a calendering roller.

The manufacturing method may further include heating the web by the calendering roller.

According to a further aspect, there is provided a textured nonwoven fabric including papermaking fibers, including a ply made of nonwoven fabric including papermaking fibers manufactured by a calendering roller, and including a design reproducing basic elements disposed in rows and columns and multiple random transverse and longitudinal lines generating a cloth-like visual texture.

The nonwoven fabric including paper fibers may be air-laid.

The nonwoven fabric including papermaking fibers may further include a fiber binder chosen among the group of latex, latex and starch, and latex and thermo-bonded fiber, and thermo-bonded fibers.

According to still a further aspect, there is provided a roll of sheet material including a textured nonwoven fabric including papermaking fibers, wound onto a core.

According to still a further aspect, there is provided a folded sheet material including a textured nonwoven fabric including papermaking fibers, cut, stacked and/or folded into a package.

According to still a further aspect, there is provided a use of a textured nonwoven fabric including papermaking fibers, as napkins, table cover, placemates, table runners, coasters, doyleys, paper towel, toilet paper rolls, wiping paper products, kitchen towel rolls, skin care or cleaning wipes, handkerchiefs, and absorbent pads.

The embodiments disclosed herein enable reduction of the contacting surface. For example, the contacting surface with the papermaking fibers ranges between 15 and 30%. Further the disclosed embodiments avoid the drawback linked to the appearance of "dark points". In case a dark point still appears, it is of smaller dimension almost unnoticeable. As a result, it is possible to produce a cloth-like textured paper that is appealing to the eyes of the consumers.

Further, the calendering roller has a pattern that does not easily gather papermaking fibers and, thus, stays clean over time even with high compression pressure during the calendering process.

BRIEF DESCRIPTION OF THE DRAWINGS

Embodiments of the present invention are illustrated by way of examples and not limited to the accompanying drawings, in which like references indicate similar elements:

FIG. 1 is a schematic representation of a pattern of a calendering roller;

FIG. 2 is a detailed view schematically representing the pattern of the calendering roller of FIG. 1;

FIGS. 3 and 4 are cross-sectional views of the detailed view of FIG. 2 according to lines AA and BB, respectively;

DETAILED DESCRIPTION OF PREFERRED EMBODIMENTS

Figure 5:
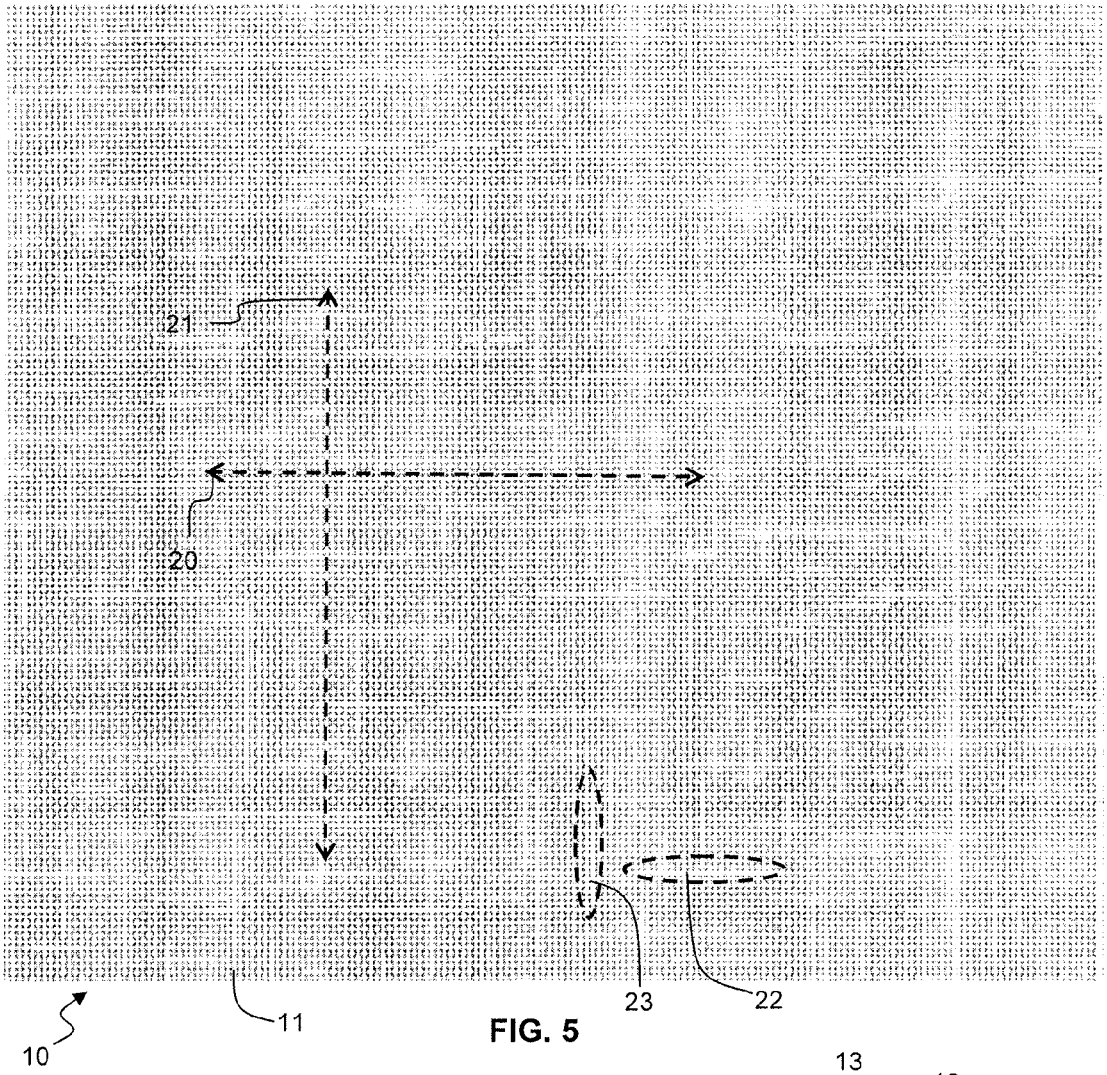
FIG. 5 is a schematic representation of a pattern of a calendering roller.

FIG. 5 is a schematic representation of a positive pattern 10 of a calendering roller. The positive pattern 10 includes a basic element 11, said basic element being repeated along multiple rows 20 and columns 21 substantially overall a peripheral surface of the calendering roller. Said repetition is regular except for multiple substantially longitudinally oriented regions 22 and transversally oriented regions 23. Said regions are of limited size with respect to the calendering roller size (length and width). They are randomly distributed over the peripheral surface of the calendering roller. This enables defining multiple random transverse and longitudinal lines in the textured nonwoven fabric including papermaking fibers, generating a cloth-like visual texture.

Figure 6:
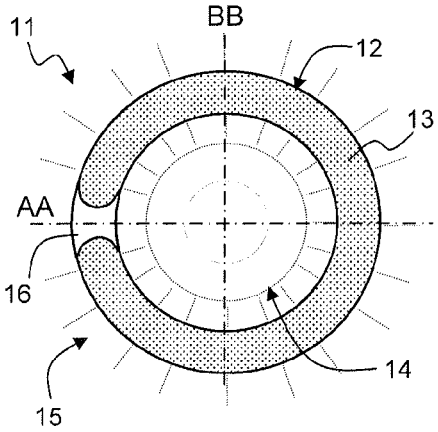
FIG. 6 is a detailed view schematically representing a basic element according to an embodiment of the invention.
Figure 7:
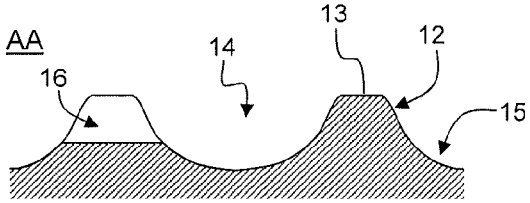
FIGS. 7 and 8 are cross-sectional views of the detailed view of FIG. 6 according to lines AA and BB, respectively.
Figure 8:
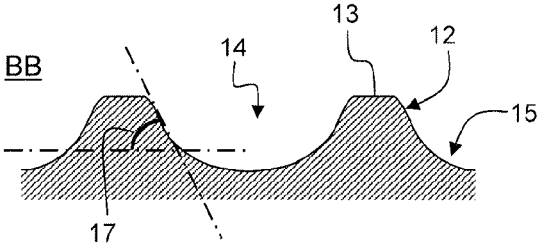

FIG. 6 is a detailed view schematically representing a basic element according to an embodiment of the invention. FIGS. 7 and 8 are cross-sectional views of the detailed view of FIG. 6 according to lines AA and BB, respectively. The basic element 11 has a ring shape 12. The ring 12 defines an apex relatively to a center portion of the ring defining a cavity 14 and a grinded surrounding zone 15. The ring 12 includes at least one radial channel 16. The radial channel 16 puts in communication, the cavity 14 and the grinded surrounding zone 15 so as to define a discontinuous calendering surface 13. The cavity 14 and the grinded surrounding zone 15 may be deeper than the radial channel 16.

Figure 9:
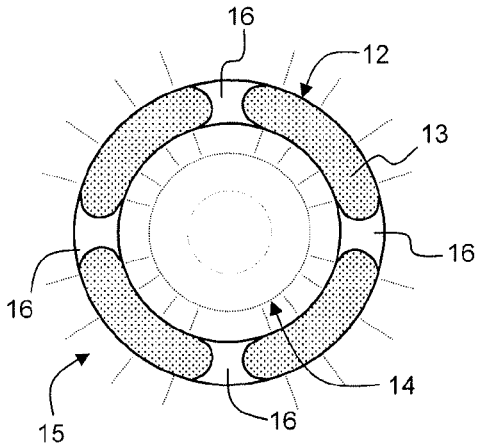
FIGS. 9 and 10 are detailed views schematically representing a basic element according to various alternative embodiments of the invention.
Figure 10:
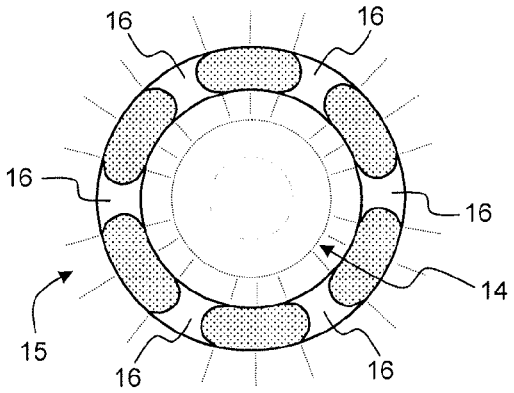

FIGS. 9 and 10 are detailed views schematically representing the basic element according to various alternative embodiments of the invention. In particular, FIG. 9 illustrates the basic element 11 including four radial channels 16 that are positioned symmetrically around the ring 12. FIG. 10 illustrates the basic element 11 including six radial channels 16. The numbers, positions and shapes of the radial channels 16 in the depicted embodiments are non-limitative examples. The skilled person will readily recognize that these numbers, positions and shapes may be changed if desired or deemed necessary with respect to, for example, the desired contacting surface to be achieved and the easiness of de-molding the papermaking fibers during the calendering process.

As an example, the size of the basic element shown in the embodiment of FIG. 9 has a width ranging from 100 to 300 μm and length ranging from 300 to 550 μm. The depth of the cavity may range between 0.18 and 0.40 mm, or between 0.20 and 0.30 mm.

In the hereinbefore described embodiments, the ring 12 has a substantially circular shape. Alternatively, the ring 12 may have an elliptical shape. The ring may have a planar apex (to be seen in FIGS. 7 and 8) forming the calendering surface 13. The cavity 14 may have a rounded bottom. The cavity 14 may have a relief angle 17 ranging between 20° and 30°.

Figure 11:
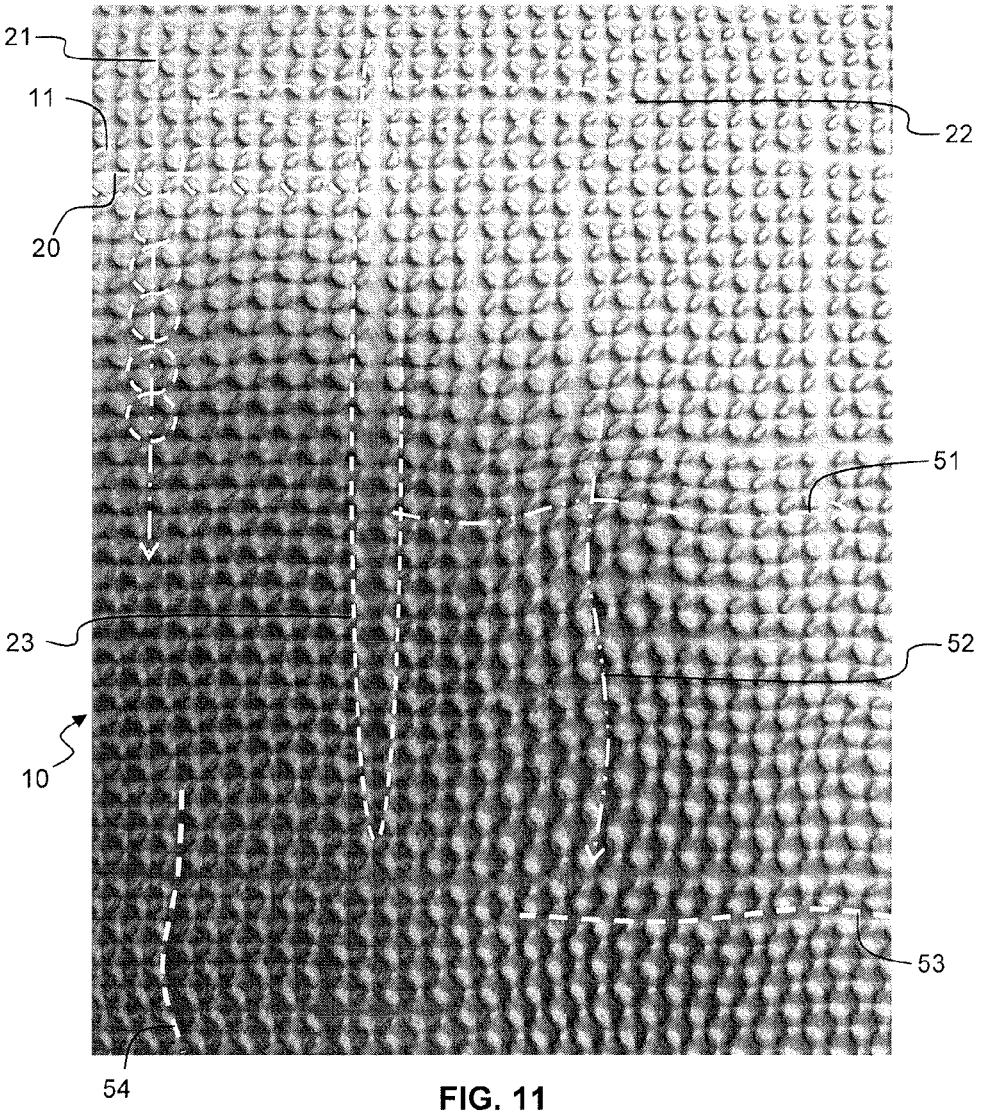
FIG. 11 is a photograph of an enlarged portion of the calendering roller schematically illustrated in FIG. 5 illustrating an embodiment of the pattern.

FIG. 11 is a photograph of an enlarged portion of the calendering roller schematically illustrated in FIG. 5. This illustrates an embodiment of the positive pattern 10, wherein the basic element 11 includes four radial channels 16 that are positioned symmetrically around the ring 12. The positive pattern 10 includes basic elements 11 disposed along the multiple rows 20 and columns 21 substantially overall the peripheral surface of the calendering roller. Further, the positive pattern 10 includes the multiple substantially longitudinally oriented regions 22 and transversally oriented regions 23. These regions are void of basic elements 11 and may be as deep as the grinded surrounding zone 15. These regions may be randomly distributed over the positive pattern. These regions have a limited size, for example a width ranging between half the size of a basic element 11 and the size of a basic element 11, and a length ranging between four basic elements 11 and forty basic elements 11.

Optionally, a part of the multiple rows 20 and columns 21 may define waviness longitudinal lines 51 and transverse lines 52, respectively.

Optionally, a part of the substantially longitudinally and transversally oriented regions 22, 23 may define waviness longitudinal lines 53 and transverse lines 54, respectively.

Figure 12:
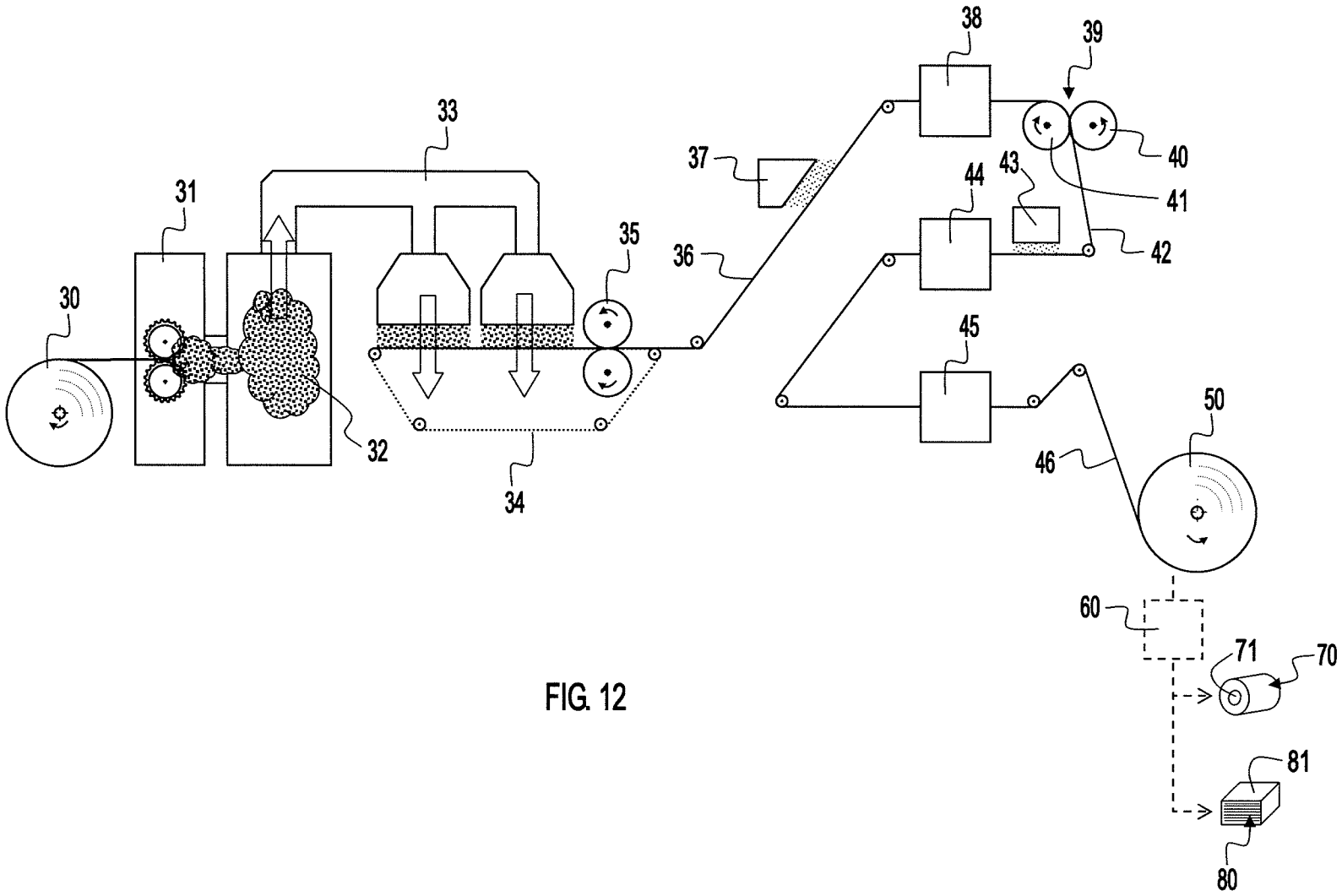
FIG. 12 schematically and partially illustrates an example of an equipment and a method of manufacturing the textured nonwoven fabric including papermaking fibers.

FIG. 12 schematically and partially illustrates an example of an equipment and method for manufacturing the textured nonwoven fabric including papermaking fibers.

Figure 13:
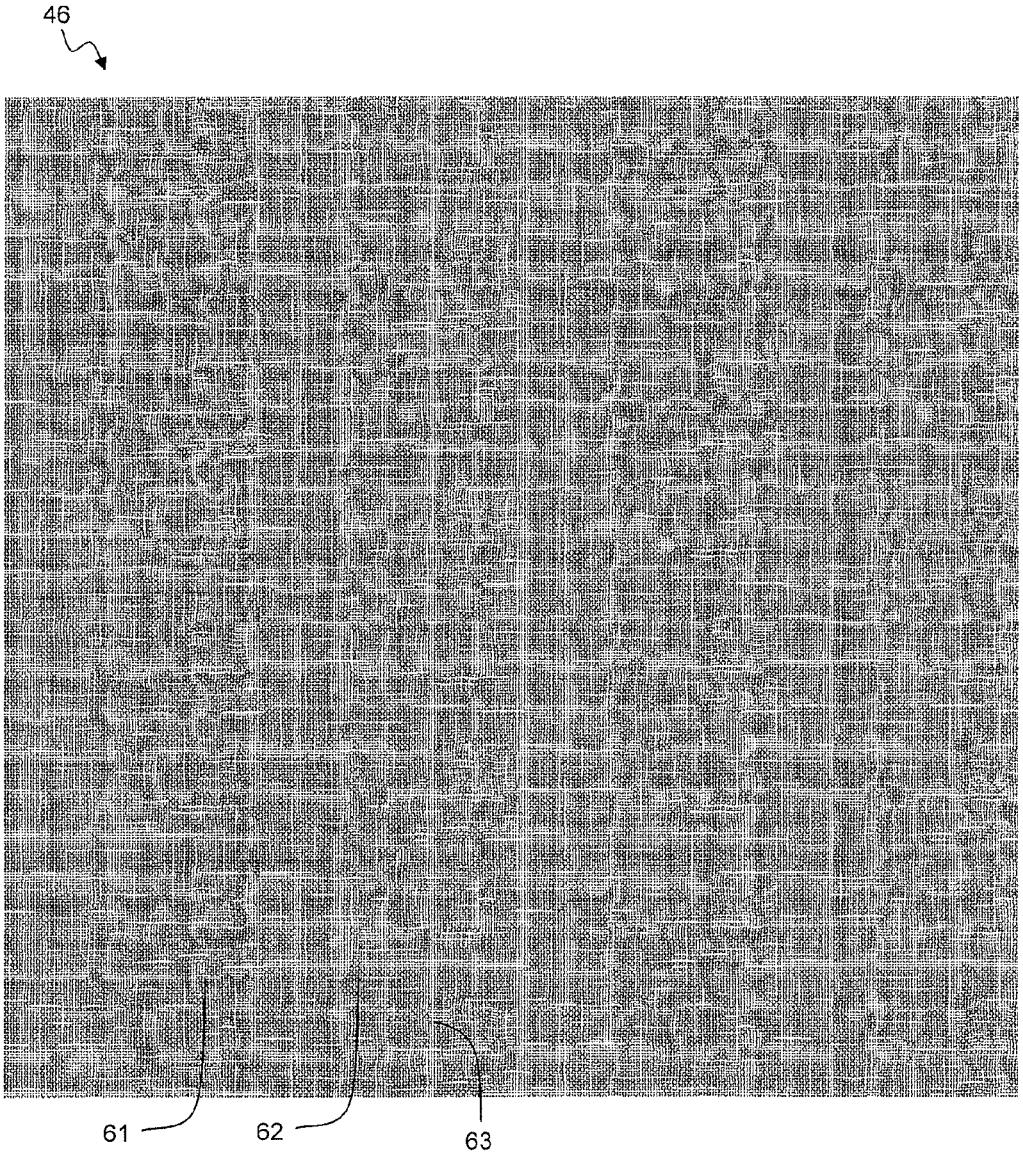
FIG. 13 is a digital image of a cloth-like textured nonwoven fabric including papermaking fibers obtained with a calendering roller and a manufacturing method of an embodiment of the invention.

A reel of fluff pulp 30 is used as raw material. It is fed into crusher 31. The fluff pulp is defibrized into fluff or free papermaking fibers 32. Other raw material may be used, for example, blend of fluff pulp and synthetic fibers, artificial fibers or other natural fibers (for instance cellulosic fibers), thermo-bonded fibers or blend with SAP (super absorbent polymer). The papermaking fibers 32 are fed into a given number of (for example two) forming chambers 33. In the forming chambers 33, the papermaking fibers 32 are transported by an air flow. The papermaking fibers 32 are deposited onto a forming fabric 34 that travels in loop below the forming chambers 33. Nearly before leaving the forming fabric 34, the formed web is compacted by a compactor 35. The compacted web resulting from this step is then transferred from the forming fabric 34 onto a transfer fabric 36. A binder is sprayed onto one side of the compacted web by a first binder sprayer 37. The binder is a latex composition such as an ethylene and vinyl acetate copolymer composition. Then, the compacted web is dried into a first drying unit 38 (e.g. at a temperature of approximately 110-120° C.). Subsequently, the compacted web is calendered by a calendering section 39. The calendering section 39 includes a calendering rollers 40 and a mating cylinder 41 in vis-à-vis, both rotating in opposite directions. The calendering roller 40 is a calendering roller including a positive pattern. The mating cylinder 41 may be a roller having a smooth surface (the mating cylinder may be made from steel or rubber material). The calendering roller may be heated. A calendered web 42 results from this step. A binder (e.g. latex) is sprayed onto the other side of the calendered web 42 by a second binder sprayer 43. As an alternative to the use of a binder sprayed by the first and second binder sprayers 37, 43, thermo-binding fibers (e.g. thermo-bonded fiber or thermo-bonded fiber and latex) can be used and mixed with papermaking fibers into the forming chambers 33. Then, the calendered web 42 is dried and cured into a second drying unit 44 (e.g. at a temperature of approximately 200° C.). The resulting web 42 is further cured and cooked by a third drying unit 45 (e.g. at a temperature of approximately 200° C.). The calendered web resulting from the above steps forms a textured nonwoven fabric including papermaking fibers 46. It may be wound onto a reel 50 as a roll of textured nonwoven fabric including papermaking fibers. The reel 50 of textured nonwoven fabric including papermaking fibers may then be fed into a converting unit 60 in order to produce napkins, paper towels, toilet paper rolls, facial rolls, wiping paper products, kitchen towel rolls, skin care or cleaning wipes, handkerchiefs, etc. . . . . FIG. 13 depicts two examples wherein the textured nonwoven fabric includes papermaking fibers may be wound onto a core 71 as a roll of sheet material 70, or may be stacked and folded into a package 81 as a folded sheet material 80.

FIG. 13 is a digital image of a textured nonwoven fabric including papermaking fibers 46 obtained with a calendering roller 40 and the exemplary manufacturing method as hereinbefore described. The textured nonwoven fabric including papermaking fibers 46 includes a design pattern 61 reproducing the shape of the basic elements disposed in rows and columns, and also the multiple random longitudinal 62 and transverse 63 lines. All of these generate a cloth-like visual texture (in the sense of simulating a woven like textile product) that is pleasant to the eyes of the consumers.

The skilled person will readily recognize that the calendering roller may include more or less basic elements and longitudinally and transversally oriented void regions provided that the nonwoven fabric including papermaking fibers is textured so as to confer a cloth-like visual texture to the nonwoven fabric including papermaking fibers.

The numbers, densities, positions and shapes of the basic elements, channels, void regions in the depicted embodiments are non-limitative examples. The skilled person will readily recognize that these numbers, densities, positions and shapes may be changed if desired or deemed necessary with respect to, for example, the desired aesthetic effect to be achieved by the textured nonwoven fabric including papermaking fibers. Further, the shape of the ring is not limited to the elliptical and circular shape depicted in the drawings. Other shapes (not shown) may provide similar technical effects with regards to the reduction of the contacting surface, for example square, rectangular or diamond shape may be acceptable.

Any reference sign in a claim should not be construed as limiting the claim. The word "comprising" does not exclude the presence of other elements than those listed in a claim. The word "a" or "an" or "at least one" preceding an element does not exclude the presence of a plurality of such element.

The invention claimed is:

1. A calendering roller used to manufacture textured nonwoven fabric comprising papermaking fibers, comprising:

a basic element having a ring shape, the ring defining an apex relatively to a center portion of the ring defining a cavity and a grinded surrounding zone, the ring comprising at least one radial channel putting in communication the cavity and the grinded surrounding zone so as to define a discontinuous calendering surface; and a repetition of said basic element along multiple rows and columns substantially overall a peripheral surface of the calendering roller, the repetition being regular except for multiple substantially longitudinally and transversally oriented regions, said regions being of limited size with respect to a calendering roller size and randomly distributed so as to define multiple random longitudinal and transverse lines in the textured nonwoven fabric comprising papermaking fibers, generating a cloth-like visual texture; and wherein the calendering roller comprises a positive pattern in which the pattern forms a contacting surface of the calendering roller.

2. The calendering roller of claim 1, wherein the ring has a shape chosen from the group consisting of an elliptical, a circular, a square, a rectangular, and a diamond shape.

3. The calendering roller of claim 1, wherein the ring comprises four radial channels symmetrically positioned around the ring.

4. The calendering roller of claim 1, wherein the ring has a planar apex and the cavity has a rounded bottom.

5. The calendering roller of claim 4, wherein the cavity has a relief angle ranging between 20° and 30°.

6. The calendering roller of claim 1, wherein at least a part of the multiple rows and columns, or the substantially longitudinally and transversally oriented regions defines waviness transverse and longitudinal lines, respectively.

7. The calendering roller of claim 1, wherein a thickness of said regions is at least approximately half a basic element size.

8. The calendering roller of claim 1, wherein a length of said regions is at least approximately four basic element size.

9. A method of manufacturing textured nonwoven fabric comprising papermaking fibers, comprising a web made of nonwoven fabric comprising papermaking fibers, the manufacturing method comprises:

producing a web made of nonwoven fabric comprising papermaking fibers by an air-laid production process, and calendering the web by a calendering roller according to claim 1.

10. The textured nonwoven fabric manufacturing method of claim 9, wherein the manufacturing method further comprises heating the web by the calendering roller.

11. A textured nonwoven fabric comprising papermaking fibers, comprising a ply made of nonwoven fabric comprising papermaking fibers manufactured by a calendering roller according to claim 1, and comprising a design reproducing basic elements disposed in rows and columns and multiple random longitudinal and transverse lines, generating a cloth-like visual texture.

12. The textured nonwoven fabric comprising papermaking fibers of claim 11, wherein the nonwoven fabric comprising papermaking fibers is air-laid.

13. The textured nonwoven fabric comprising papermaking fibers of claim 12, wherein the nonwoven fabric comprising papermaking fibers further comprises a fiber binder chosen from the group consisting of latex, latex and starch, and latex and thermo-bonded fiber.

14. A roll of sheet material comprising a textured nonwoven fabric comprising papermaking fibers according to claim 11 wound onto a core.

15. A folded sheet material comprising a textured nonwoven fabric comprising papermaking fibers according to claim 11, cut, stacked and/or folded into a package.

16. The textured nonwoven fabric of claim 11 is used as napkins, table cover, placemats, table runners, coasters, doilies, paper towels, toilet paper rolls, wiping paper products, kitchen towel rolls, skin care or cleaning wipes, handkerchiefs or absorbent pads.

* * * * *